US005724698A

United States Patent [19]

Mondragon

[11] Patent Number: 5,724,698

[45] Date of Patent: Mar. 10, 1998

[54] FOLDED POCKET TOWEL

[76] Inventor: Deborah Koch M. Mondragon, 13416 Reindeer St., Moreno Valley, Calif. 92553

[21] Appl. No.: 628,932

[22] Filed: Apr. 8, 1996

[51] Int. Cl.[6] ..... A41D 27/00

[52] U.S. Cl. ..... 15/209.1; 15/210.1; D6/608; 2/247; 2/251; 2/252; 2/311

[58] Field of Search ..... 15/209.1, 210.1, 15/208; D6/608, 602, 603, 595, 596; 2/253, 252, 251, 247, 311, 312, 47, 48, 46, 279; 383/66, 84, 30, 31, 902, 4, 11

[56] References Cited

U.S. PATENT DOCUMENTS

| | | | |
|---|---|---|---|
| 968,924 | 8/1910 | Enge | 15/209.1 |
| 2,317,176 | 4/1943 | Byrd | 2/48 |
| 2,669,737 | 2/1954 | Evans | 15/209.1 |
| 4,545,079 | 10/1985 | Bakken | 2/48 |
| 4,815,510 | 3/1989 | Edelist | 2/251 |
| 5,003,634 | 4/1991 | Bankman | 2/253 |
| 5,012,543 | 5/1991 | Lewis, Sr. | 15/209.1 |
| 5,075,918 | 12/1991 | Zeltner et al. | 15/210.1 |
| 5,346,308 | 9/1994 | Buhot et al. | 383/31 |
| 5,443,880 | 8/1995 | Wike | D6/608 |
| 5,573,441 | 11/1996 | Smith | 2/247 |

*Primary Examiner*—Gary K. Graham

[57] ABSTRACT

An improved dual-purpose golf and gym folded pocket towel having a concealed pocket therein for holding articles. the concealed pocket has zipper-type closure, and an adjustable hook and loop fastener attachment strap for securement to golf and gym equipment/apparatus. The folded pocket towel is uniquely designed to allow unhampered use by golf and gym patrons in cleaning golf implements and equipment and use in drying perspiration from face, hands and gym equipment/apparatus while carrying both accessories and personal items of the a fore mentioned patrons. An adjustable hook and loop fastener attachment strap provides convenient securemnet to a variety of golf and gym equipment/apparatus while adding to ease and accessibility of pocket/container therein.

1 Claim, 2 Drawing Sheets

FOLDED POCKET TOWEL

FIELD OF THE INVENTION

The present invention relates to a towel with dual-function of cleaning golf implements/equipment and use in drying perspiration from face and gym equipment/apparatus while carrying both accessories and personal items of both golf and gym patrons. The partial folding of the towel creates a concealed receptacle pocket with a concealed zipper-type closure and an adjustable hook and loop fastener attachment strap placed at the base of pocket for securement to appropriate golf and gym equipment and apparatus. The towel article is partially folded onto itself forming the base of pocket which allows the remaining portion of the towel article as unhampered towel utility for golf and gym patrons.

BACKGROUND OF THE INVENTION

Various types of towels are known in the prior art. A typical example of such a towel is to be found in: U.S. Pat. No. 968,924 which issued to August Enge on Aug. 30, 1910, discloses a slate cleaner and sponge pocket for school slates. U.S. Pat. No. 2,317,176 which issued to M. A. Byrd, on Apr. 20, 1943, discloses a container bag and outer garment suitable for carrying knitting supplies or other uses. U.S. Pat. No. 2,669,737 which issued to A. E. Evans, on Feb. 23, 1954, discloses a wash cloth with a built in soap pocket. U.S. Pat. No. 4,403,366 which issued to Harold Lucke, on Sept. 15, 1981, discloses a removable towel means for mounting on the belt, pants, or accessories worn by or in possession of the user. U.S. Pat. No. 4,545,079 which issued to Paula S. Bakken, on Oct. 8, 1985, discloses a waitress apron with secured pockets. U.S. Pat. No. 4,815,510 which issued to Maurine S. Edelist, on Mar. 28, 1989, discloses a security pouch to be worn on an undergarment suspendable beneath the arm of a wearer. U.S. Pat. No 4,885,195, which issued to Change III on Dec. 5, 1989, discloses an exercise towel with magnetic anchoring means for attaching to metallic gym equipment. U.S. Pat. No. 5,003,634 which issued to Robert J. Brinkman, on Apr. 2, 1991, discloses an inclement weather or out of doors seat protector that folds up into a belt-like container. U.S. Pat. No. 5,012,543, which issued to John Lewis, Sr. on May 7, 1991, discloses on athletic towel with pocket designed for use by joggers which secures around the individual's waist. U.S. Pat. No. 5,075,918 which issued to Barry Zelter/et. Al., on Dec. 31, 1991, discloses a combination cleaning device and carrying case that secures to a golf bag. U.S. Pat. No. 5,441,789 which issued to Gary walker, on Jan. 21, 1994, discloses an attachment type beach towel and chair cover. U.S. Pat. No. 5,361,435, which issued to Brian Reeves on Mar. 28, 1994, discloses a portable beach towel with a built-in hidden pouch for storing valuables. U.S. Pat. No. 5,346,308 which issued to Dominique j. Buhot/et. Al., on Sep. 13, 1994, discloses a beach towel that converts to a bag with storage pockets. U.S. Pat. No. 5,443,880 which issued to Curtis wike, on aug. 22, 1995, discloses a beach towel or blanket with pockets that may be lined with water repellent material. U.S. Pat. No. 5,573,441, which issued to Cynthia D. Smith, on Nov. 12, 1996, discloses a security pouch for holding valuables that attaches to the center of a brassiere. While the above mentioned devices are directed to towels, none of these devices disclose a functional pocket golf/gym towel suitable for dual-purpose use. The adjustable hook and loop fastener attachment strap at the base of pocket allows attachment to a variety of securements to the appropriate golf and gym equipment/apparatus. The concealed zipper-type closure on the unique partial fold-over pocket acts as receptacle for accessories and personal items related to golf and gym patrons. This dual-purpose golf and gym towel must possess certain characteristics as to its use being of a simplistic design so its function is easily understood, it can be attached and removed in an easy and rapid fashion. My unique design of concealed folded-over pocket with zipper-type closure and adjustable hook and loop fastener attachment strap at the base of pocket forms a dual-purpose golf and gym towel that possesses all the needed functional towel with pocket characteristics so as to appeal to the obvious golf and gym patron consumer demand for such a simplistic useful invention.

SUMMARY OF THE INVENTION

In view of the foregoing disadvantages inherent in the known types of towels now present in the prior art, the present invention provides an improved dual-purpose golf and gym towel. The present invention is to provide a dual-purpose golf and gym towel having a simplistic partial fold-over structure compartment pocket means for receiving and retaining articles while maintaining a functional purpose of cleaning golf implements and equipment and use in drying perspiration from face, hands and gym equipment/apparatus. The present invention is particularly useful as it provides an adjustable hook and loop fastener attachment strap for securement to golf and gym equipment and apparatus making the articles function more useful, accessible and convenient. The invention provides an concealed compartment/pocket towel article, which is preferably made from a washable material such as a terry cloth sheet material or the like. In the article a concealed receptacle compartment is formed by a partial folding of one end of the textile material back onto itself attaching, preferably by sewing, the adjacent sides of the base of pocket. The opposing side of the base of pocket is the pocket opening. The pocket opening has a zipper-type closure to provide securement of the golf and gym patrons items. The article has a zipper-type closure is concealed by a over hanging flap edge of towel material to which the zipper-type closure is attached. The over hanging flap edge of towel material conceals the zipper-type closure to disguise the pocket towel as an obvious means as a container of items.

BRIEF DESCRIPTION OF THE DRAWINGS

This invention will be more fully understood from the following detailed description of the preferred embodiment thereof when read in conjunction with the appended drawing wherein.

DESCRIPTION OF THE PREFERRED EMBODIMENT

Figure 1:
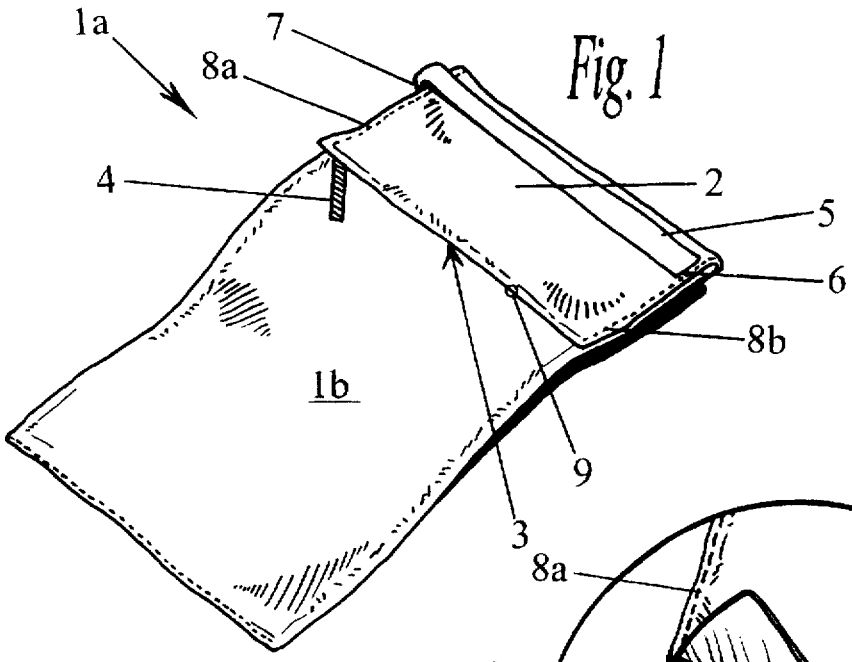
FIG. 1. is a perspective illustration of a golf and gym towel with a concealed security pocket and adjustable hook and loop fastener attachment strap.
Figure 2A:
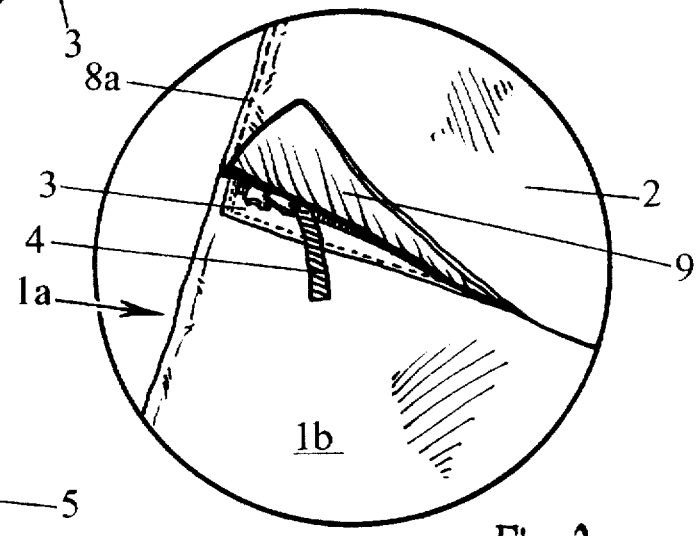
FIG. 2*a*. is a close-up of zipper-type closure construction exampled in zipper form and displaying the concealed element (over hang flap of towel material) of the zipper-type closure.
Figure 2:
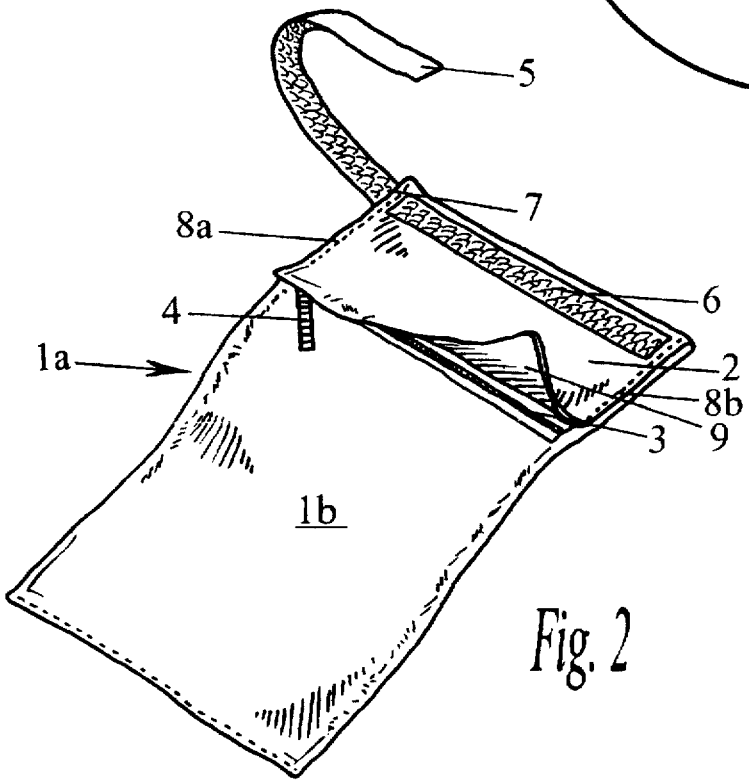
FIG. 2. is a perspective illustration of the placement of the zipper-type closure shown therein as a zipper with zipper tab. Also partial fold-over construction of receptacle pocket shown.
Figure 3:
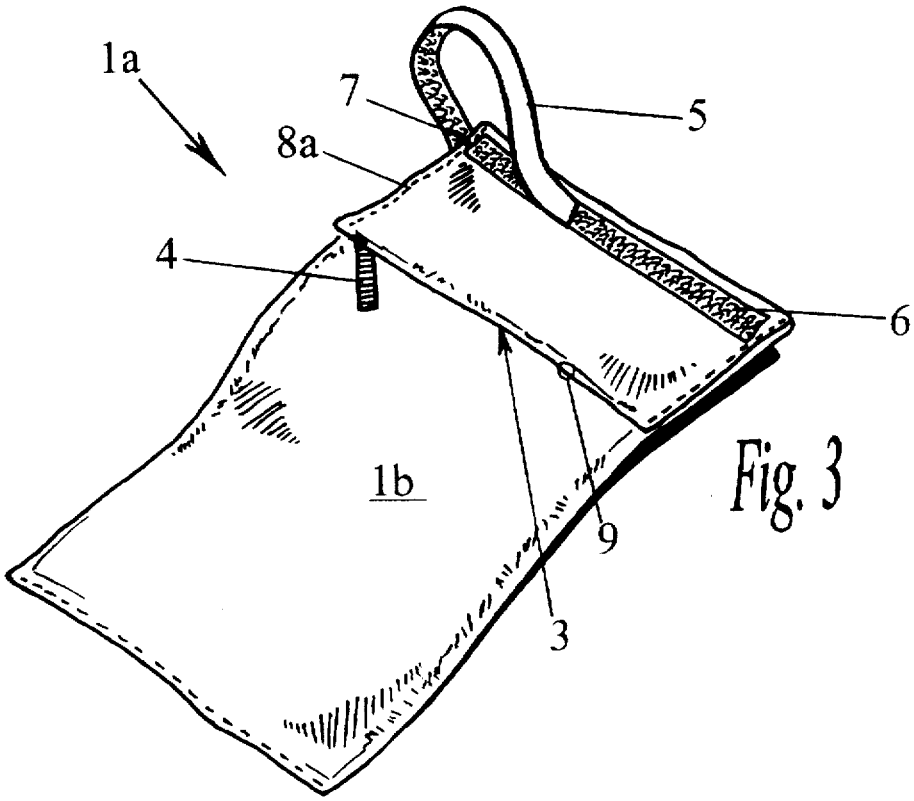
FIG. 3. is a perspective illustration of the functional golf and gym towel use of the adjustable hook and loop fastener attachment strap secured at the base of pocket.
Figure 4:
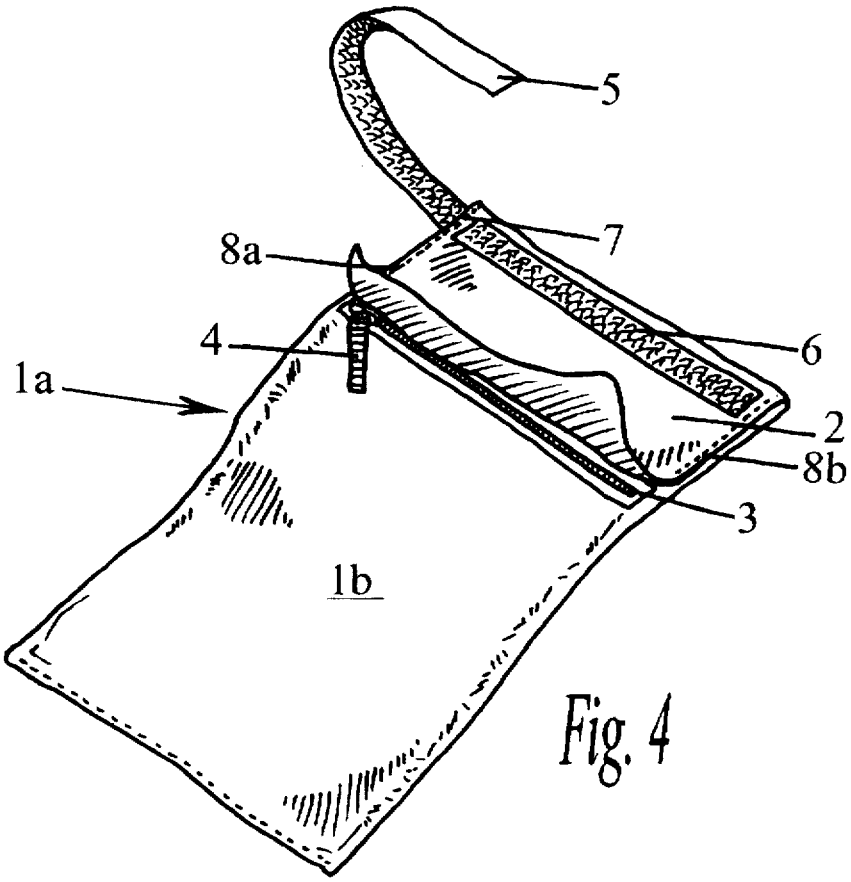
FIG. 4 is a perspective illustration of the towel wherein the flap is bent back fully exposing the zipper-type closure.

With reference now to the drawings, and in particular to FIG. 1 thereof, a new and improved golf and gym towel invention and generally designated by the reference numeral 1*a* will be described. More specifically, it will be noted that the first embodiment 1 of the invention includes an elongated generally rectangular fabric piece 1*b*, preferably formed from a washable terry cloth material, FIG. 2*a* concealed pocket 2, is constructed by a partial folding over of one end of textile material piece of the rectangular fabric piece 1*b*. This partial folded-over textile material is secured on opposite sides 8*a* and 8*b* to forming a unique integrated receptacle. 8*a* and 8*b* includes a security flap 9 (made from the pockets' over hanging flap of towel material ) for securing the concealment of the zipper-type closure 3. FIG. 2*a* which in a closed position to carry various personal items or containment of recreation items such as golf balls, tennis balls, weight lifting gloves, etc. Access to the concealed compartment is provided in the embodiment of FIG. 2*a* by zipper-type closure including zipper tab 4 for ease of closure. An adjustable hook and loop fastener attachment strap 5 FIG. 3 is secured at the base of pocket 10 and one end 6 in the between fold of fabric forming the base of pocket 10 and is dimensioned for securement around a variety of golf and gym equipment/apparatus. FIG. 3 adjustable hook and loop fastener attachment strap 5 the underside of which has a hook fastener strip 5 affixed thereto for mating with the opposite loop fastener strip 7 on textile material 2 forming the base of pocket 10 receptacle. Advantageously, FIG. 4 the concealed pocket (2), zipper-type closure (3), and adjustable hook and loop attachment strap (5) are all located at the base of pocket 10 of the rectangular textile material enabling the full unhampered use of the remaining article 1*b* for uninhibited dual purpose use as a golf and gym towel article for cleaning golf implements and equipment and use in drying perspiration from face, hands and gym equipment/apparatus while carrying both accessories and personal items of both golf and gym patrons.

CLAIM

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. An elongated folded pocket towel for cleaning equipment as well as drying perspiration from hands and face of a user, said towel comprising:

an elongated generally rectangular fabric piece formed from a washable absorbent cloth material, said fabric piece having a first portion folded about an axis perpendicular to said elongation with part of lateral sides thereof being secured to a remaining second portion to form a pocket, said first portion has a length along said elongation substantially shorter than a length of said second portion along said elongation;

a tabbed zipper means attached between and to said portions to define a closable entrance to the pocket;

a free end part of the first portion overlies the zipper means and forms a flap which conceals said zipper means;

a first elongated strap lying in the fold between the first and second portions of the fabric piece and secured thereto, the first strap extends from said fold and has one of hook and loop fasteners thereon;

a second elongated strap secured to the first portion of the fabric piece and having the other of hook and loop fasteners thereon, wherein the straps cooperate together to form adjustable attaching means for attaching the pocket towel to a variety of equipment and apparatus.

* * * * *